US005990071A

United States Patent [19]

Shubkin

[11] Patent Number: 5,990,071

[45] Date of Patent: Nov. 23, 1999

[54] METHOD FOR INHIBITING TARNISH FORMATION WHEN CLEANING SILVER WITH ETHER STABILIZED, N-PROPYL BROMIDE-BASED SOLVENT SYSTEMS

[75] Inventor: Ronald L. Shubkin, Baton Rouge, La.

[73] Assignee: Albemarle Corporation, Richmond, Va.

[21] Appl. No.: 09/104,872

[22] Filed: Jun. 25, 1998

[51] Int. Cl.[6] ..... C11D 3/24; C11D 3/43

[52] U.S. Cl. ..... 510/412; 510/175; 510/255; 510/256; 510/258; 510/273; 510/401; 252/364

[58] Field of Search ..... 510/412, 175, 510/255, 256, 258, 273, 401; 252/364

[56] References Cited

U.S. PATENT DOCUMENTS

| | | | |
|---|---|---|---|
| 3,758,503 | 9/1973 | Hartzler | 260/327 M |
| 5,403,507 | 4/1995 | Henry | 252/170 |
| 5,492,645 | 2/1996 | Oshima et al. | 252/171 |
| 5,616,549 | 4/1997 | Clark | 510/412 |
| 5,814,595 | 9/1998 | Flynn et al. | 510/411 |
| 5,827,812 | 10/1998 | Flynn et al. | 510/411 |

FOREIGN PATENT DOCUMENTS

| | | |
|---|---|---|
| 61-19700 | 1/1986 | Japan . |
| 6119700 | 1/1986 | Japan . |
| 62-7798 | 1/1987 | Japan . |

*Primary Examiner*—Christine Skane
*Attorney, Agent, or Firm*—E. E. Spielman, Jr.

[57] ABSTRACT

Silver tarnishing is inhibited when using ether stabilized, n-propyl bromide based cleaning compositions by including a small amount of an acetylenic compound in the compositions.

17 Claims, No Drawings

METHOD FOR INHIBITING TARNISH FORMATION WHEN CLEANING SILVER WITH ETHER STABILIZED, N-PROPYL BROMIDE-BASED SOLVENT SYSTEMS

This invention relates generally to cleaning processes using n-propyl bromide based cleaning solvent compositions and, more particularly, to the cleaning of articles, which have exposed silver or silver-plated surfaces, using n-propyl bromide-based cleaning solvents, without causing the silver surfaces to become tarnished.

BACKGROUND n-Propyl bromide is recognized as being an environmentally friendly solvent for cold and vapor degreasing processes. Because n-propyl bromide may be reactive to metals and its hydrolysis products may be corrosive towards metals, especially when used in vapor degreasing processes, n-propyl bromide-based cleaning solvent compositions usually include one or more stabilizers such as nitroalkanes, ethers, amines, and/or epoxides (see, for example, U.S. Pat. No. 5,616,549) and also may contain an assistant stabilizer such as an acetylene alcohol (see, for example, U.S. Pat. No. 5,492,645). One application for such cleaning compositions is the removal of residues from precision metal and electronic parts. The parts are generally cleaned using a vapor degreaser apparatus in which the part is placed in a vapor layer above the boiling solvent, such that the solvent condenses on the part and rinses away the residues. This may or may not be followed by immersion in the boiling solvent or in a sump filled with the solvent and equipped to provide ultrasonic agitation. Although n-propyl bromide has a very low tendency to tarnish silver and silver plate when used by itself, it has been found that when an ether is added to the n-propyl bromide to prevent corrosion of the metals in the parts, severe tarnishing of silver surfaces occurs in a very short time at the boiling temperature of the solvent. Cyclic ethers, such as 1,3 dioxolane, are especially prone to promoting such tarnishing. This makes the otherwise effective and environmentally friendly, stabilized, n-propyl bromide-based cleaning solvent compositions unsuitable for use for cleaning parts which are manufactured using silver-based solder or which are silver plated to enhance their performance in end-use applications. It has now been found that such tarnish formation can be effectively inhibited by the presence of small amounts of certain acetylenic compounds in the ether containing n-propyl bromide-based cleaning solvent compositions. According to Japanese patent JP 61019700 A2 860128, Toa Gosei Chemical Industry Co. Ltd., acetylene alcohols have been used to avoid discoloration of silver-plated lead frames when vapor cleaning them with a chlorinated solvent, 1,1,1-trichloroethane, by itself, caused discoloration.

SUMMARY OF THE INVENTION

In accordance with this invention, there is provided a method for inhibiting tarnish formation when contacting a silver surface with an ether containing n-propyl bromide-based cleaning composition, said method comprising including in said cleaning composition at least one acetylenic compound which is effective to inhibit the tarnishing of the silver surface.

Also provided is a solvent composition comprising:

(a) n-propyl bromide, (b) ether, and (c) a silver tarnish inhibiting amount of at least one $C_3$–$C_8$ acetylenic hydrocarbon or halohydrocarbon compound.

DETAILED DESCRIPTION

The n-propyl bromide for use in the process of the invention is, preferably, at least about 98% pure and, more preferably, the n-propyl bromide is supplied to the composition as 99+wt. % n-propyl bromide, with the most common impurity being isopropyl bromide. The weight percentages of n-propyl bromide which are recited in this specification are based on the total weight of n-propyl bromide and impurities. The isopropyl bromide impurity is naturally found in the raw n-propyl bromide product, but its presence can be attenuated by distillation. It is not a benign impurity as it is very much less stable than n-propyl bromide and, thus, can result in aggressive corrosion. For vapor degreasing and cleaning, the isopropyl bromide content should be kept low, for example within the range of from about 0.01 to about 0.5 wt. %. n-Propyl bromide can be purchased commercially from Albemarle Corporation, Richmond, Va.

Metals such as aluminum, magnesium and titanium can catalyze the dehydrohalogenation of the n-propyl bromide to produce corrosive materials such as HBr. Therefore, the cleaning compositions also include a stabilizer system for the n-propyl bromide. The stabilizer system preferably is present in amounts of from about 1 to about 8 wt. % based on the total weight of cleaning composition.

Ethers are used in the stabilizer systems as metal passivators. Non-limiting examples of ether passivators include 1,2-dimethoxyethane, 1,4-dioxane, 1,3-dioxolane, diethyl ether, diisopropyl ether, dibutyl ether, trioxane, alkyl cellosolves in which the alkyl group has 1 to 10 carbon atoms such as methyl cellosolve, ethyl cellosolve and isopropyl cellosolve, dimethyl acetal, γ-butyrelactone, methyl t-butyl ether, and tetrahydrofuran. The ethers are present either singularly or in the form of a mixture of two or more of them, preferably in amounts of from about 1.0 to 5.0 wt. % based on the total weight of cleaning composition.

Beside ethers, the stabilizer systems generally include one or more other compounds including additional metal passivators and, also, acid acceptors. Non-limiting examples of suitable types of these other compounds for use in stabilizing the n-propyl bromide based cleaning compositions include epoxides, nitroalkanes and amines.

Non-limiting examples of epoxides include epichlorohydrin, propylene oxide, butylene oxide, cyclohexene oxide, glycidyl methyl ether, glycidyl methacrylate, pentene oxide, cyclopentene oxide and cyclohexene oxide. They are usable either singularly or in the form of a mixture of two or more of them.

Non-limiting examples of nitroalkanes include nitromethane, nitroethane, 1-nitropropane, 2-nitropropane and nitrobenzene. They are usable either singularly or in the form of a mixture of two or more of them.

Non-limiting examples of amines include hexylamine, octylamine, 2-ethylhexylanine, dodecylamine, ethylbutylamine, hexylmethylamine, butyloctylamine, dibutylamine, octadecylmethylamine, triethylamine, tributylamine, diethyloctylamine, tetradecyldimethylamine, diisobutylamine, diisopropylamine, pentylamine, N-methylmorpholine, isopropylamine, cyclohexylamine, butylamine, isobutylamine, dipropylamine, 2,2,2,6-tetramethylpiperidine, N,N-di-allyl-p-phenylenediamine, diallylamine, aniline, ethylenediamine, propylenediamine, diethylenetriamine, tetraethylenepentamine, benzylamine, dibenzylamine, diphenylamine and diethylhydroxyamine. They are usable either singularly or in the form of a mixture of two or more of them.

When present, preferred amounts of each type of these other stabilizer compounds include from about 0.05 to about 1.0 wt. % epoxide, from about 0.05 to about 1.0 wt. % nitroalkane and from about 0.05 to about 1.0 wt. % amine, with each of the above percentages being based on the total weight of cleaning composition.

The acetylenic compounds for use as tarnish inhibitors in the process and compositions of the invention contain at least one triple carbon-carbon bond. Non-limiting example of such acetylenic compounds include straight and branched chain $C_3$ to $C_8$ hydrocarbons, halohydrocarbons and alcohols such as 2-methyl-3-butyn-2-ol, 2-butyn-1-ol, 3-butyn-1-ol, 3-butyn-2-ol, propargyl alcohol (2-propyn-1-ol), propargyl bromide (3-bromopropyne), propargyl chloride (3-chloropropyne), 1-hexyne, 3-hexyne, and the like. The acetylenic compounds are used, either singly or in combination, in tarnish inhibiting amounts of, preferably, from about 0.01 to about 1.0 wt. %, and more preferably, from about 0.1 to about 0.5 wt. %, based on the total weight of cleaning composition.

Besides the stabilizer system and acetylenic compound(s) the balance of the cleaning composition will, preferably, be the n-propyl bromide cleaning solvent. However, the solvent portion may also include co-solvents in amounts which do not cause the cleaning solvent composition to have a flash point or otherwise harm the safety and efficiency of the cleaning composition. Examples of such co-solvents include hydrocarbons, fluorocarbons, hydrofluorocarbons, hydrofluoroethers, chlorocarbons, hydrochlorocarbons, fluorochlorocarbons and hydrochlorofluorocarbons. Generally, the n-propyl bromide will constitute at least about 50 wt. % percent, and more preferably at least about 80 wt. % of the cleaning solvent composition.

The acetylenic additives are especially useful for tarnish prevention in cleaning processes where the parts are immersed in hot solvent or solvent vapors, but they are also effective with cleaning processes in cold solvent and where solvent immersion is used in conjunction with agitation.

The invention is further illustrated by, but is not intended to be limited to, the following examples.

EXAMPLE 1

Sheets of silver-plated steel were cut into coupons approximately 3 inches long and 0.5 inches wide. A hole was punched in one end of each coupon. In order to determine the relative amount of tarnish formation with different n-propyl bromide solvent formulations, 125 ml Erlenmeyer flasks were filled with 50 ml of the test solvent. One silver-plated coupon was placed in each flask with the punched hole at the top. Approximately ¾ inch to 1 inch of each coupon was submerged beneath the surface of the solvent. Each flask was attached to a water-cooled condenser and placed on a heating mantle. The time to heat the solvent to boiling (71° C.) was approximately 5 minutes. Total time for the test was 15 minutes (ca. 10 minutes at boiling). The flasks were raised from the heating mantles and allowed to cool for about one minute. The condensers were removed from the flasks and the coupons were removed from the solvent with a pair of tweezers. The coupons were numbered with a black marker after they were removed from the solvent. Digital photos were taken of each coupon to document the degree of tarnish. The composition of the test solvents is given in Table I. In each case, the balance of the solvent composition was n-propyl bromide. The compositions that demonstrate the effect of adding an ether (1,3-dioxolane) to the cleaning solvent and the corresponding coupons are nos. 1–5. The formulations that show the effect of adding 0.1 wt. % of an acetylenic compound to a formulation containing 1,3-dioxolane and the corresponding coupons are nos. 6–14.

TABLE I

Additives in n-Propyl Bromide Formulations

| No. | 1,3-Dioxolane, wt. % | 1,2-Epoxybutane, wt. % | Nitromethane, wt. % | Acetylene, 0.1 wt. % |
|---|---|---|---|---|
| 1 | — | — | — | — |
| 2 | — | 0.15 | — | — |
| 3 | 4.00 | 0.15 | — | — |
| 4 | — | 0.50 | 0.50 | — |
| 5 | 4.00 | 0.50 | 0.50 | — |
| 6 | 4.00 | 0.50 | 0.50 | 2-methyl-3-butyn-2-ol |
| 7 | 4.00 | 0.50 | 0.50 | propargyl alcohol |
| 8 | 4.00 | 0.50 | 0.50 | 3-butyn-1-ol |
| 9 | 4.00 | 0.50 | 0.50 | 2-butyn-1-ol |
| 10 | 4.00 | 0.50 | 0.50 | 3-butyn-2-ol |
| 11 | 4.00 | 0.50 | 0.50 | 1-hexyne |
| 12 | 4.00 | 0.50 | 0.50 | 3-hexyne |
| 13 | 4.00 | 0.50 | 0.50 | propargyl bromide |
| 14 | 4.00 | 0.50 | 0.50 | propargyl chloride |

Results

The tarnish observed on each coupon at the conclusion of the test may be qualitatively described as:

1. Control—No Clean—No tarnish.
2. No Dioxolane—Very light yellowing below surface of solvent (barely visible).
3. 4% Dioxolane—Very dark tarnish below surface of solvent.
4. No Dioxolane—No tarnish.
5. 4% Dioxolane—Very dark tarnish below surface of solvent.
6. 4% Dioxolane+2-methyl-3-butyn-2-ol—Thin line of tarnish at liquid/vapor interface.
7. 4% Dioxolane+propargyl alcohol—very slight tarnish on one side.
8. 4% Dioxolane+3-butyn-1-ol—Very slight tarnish in vapor zone.
9. 4% Dioxolane+2-butyn-1-ol—Very, very slight tarnish (barely visible).
10. 4% Dioxolane+3-butyn-2-ol—No tarnish.
11. 4% Dioxolane+1-hexyne—Light tarnish.

12. 4% Dioxolane+3-hexyne—Medium to dark tarnish. Less than No. 5.
13. 4% Dioxolane+propargyl bromide—Light to medium tarnish.
14. 4% Dioxolane+propargyl chloride—Light tarnish.

n-Propyl bromide by itself or with an epoxy and/or nitromethane stabilizer has a very low tendency to tarnish silver and silver plate as shown by coupon nos. 1, 2 and 4. The addition of a commonly used metal passivator based on an ether structure (specifically 1,3-dioxolane) causes severe tarnishing in a short period of time at the boiling temperature of the solvent as shown by coupon nos. 3 and 5. As shown by coupon nos. 6–14, the addition of a small amount (0.1 wt. %) of an acetylenic compound inhibited tarnishing in the presence of the ether. The various acetylenic alcohols tested were all effective at 0.1 wt. %, which seemed to be slightly below the amount needed for complete elimination of tarnish under the test conditions. This was also the case with 1-hexyne and propargyl chloride. It appears that 3-hexyne and propargyl bromide were less effective under the test conditions and would need to be used at higher concentrations.

EXAMPLE 2

The cleaning of lead frames, each having fifteen copper prongs with a white-silver coated area on each prong, was carried out using a Branson Vapor degreaser (5 gallon capacity) equipped with ultrasonics (40 MHz) in the rinse sump. For each cycle of cleaning, ten parts were placed in a rack in a steel basket. The parts were placed so that they stood on edge, with the white-silver coated prongs at the top. The basket was then moved through each step of the cleaning cycle.

The cleaning cycle was first run using a cleaning solvent composition of 95 wt. % n-propyl bromide, 4.0 wt. % dioxolane, 0.5 wt. % 1,2-epoxybutane and 0.5 wt. % nitroethane. The cleaning cycle was then repeated with a second group of ten parts after 0.1 wt. % of 2-methyl-3-butyn-2-ol had been added to the cleaning solvent in the vapor degreaser. The cleaning cycle in each case was as follows:

1. Hang basket in vapor zone for 40 seconds;
2. Place basket in warm rinse sump with ultrasonics for 15 seconds;
3. Shut off ultrasonics and rinse for 14 seconds;
4. Hang in vapor zone for 4 minutes;
5. Dry in air for approximately 2 minutes;
6. Place in plastic bag with zip top closure.

The prongs of the first batch of parts were visibly darker than the second batch of parts which showed only a slight yellowing of the white areas.

What is claimed is:

1. A method for inhibiting tarnish formation when contacting a silver surface with an n-propyl bromide-based cleaning composition which contains a cyclic ether passivator, said method comprising including in said cleaning composition at least one acetylenic compound which is effective to inhibit the tarnishing of said silver surface, wherein said acetylenic compound is selected from the group consisting of $C_3$ to $C_8$ acetylenic hydrocarbons, $C_3$ to $C_8$ acetylenic halohydrocarbons, and mixtures thereof.

2. The method of claim 1 wherein the amount of acetylenic compound present is from about 0.01 to about 1.0 weight percent, based on the total weight of cleaning composition.

3. The method of claim 1 wherein the amount of acetylenic compound present is from about 0.1 to about 0.5 weight percent, based on the total weight of cleaning composition.

4. The method of claim 1 wherein said cyclic ether is 1,3-dioxolane.

5. The method of claim 1 wherein said acetylenic compound is selected from the group consisting of propargyl bromide (3-bromopropyne), propargyl chloride (3-chloropropyne), 1-hexyne, and 3-hexyne, and mixtures thereof.

6. The process according to claim 1 wherein said cyclic ether is selected from the group consisting of 1,4-dioxane, 1,3-dioxolane, trioxane, δ-butyrolactone, and tetrahydrofuran.

7. A process for cleaning an electronic part which includes a silver containing surface, without causing said surface to become tarnished, said process comprising contacting said part with a cyclic ether passivator containing n-propyl bromide-based cleaning composition, which composition contains a tarnish inhibiting amount of at least one acetylenic compound which is effective to prevent silver tarnishing which would otherwise occur due to the presence in said composition of said cyclic ether, wherein said acetylenic compound is selected from the group consisting of $C_3$ to $C_8$ acetylenic hydrocarbons, $C_3$ to $C_8$ acetylenic halohydrocarbons, and mixtures thereof.

8. The process of claim 7 wherein said cleaning composition contains from about 0.01 to about 1.0 weight percent of said acetylenic compound, based on the total weight of cleaning composition.

9. The process of claim 7 wherein said part is contacted with hot vapor above said cleaning composition which has been heated to boiling.

10. The process of claim 7 wherein said part is immersed in said cleaning composition at its boiling temperature.

11. The process of claim 7 wherein said part is immersed in said cleaning composition at a temperature which is less than its boiling temperature.

12. The process of claim 7 wherein said part is immersed in said cleaning composition and subjected to ultrasonic agitation.

13. The process according to claim 7 wherein said cyclic ether is selected from the group consisting of 1,4-dioxane, 1,3-dioxolane, trioxane, δ-butyrolactone, and tetrahydrofuran.

14. An n-propyl bromide-based solvent composition which comprises:

a. n-propyl bromide
b. cyclic ether passivator, and
c. a silver tarnish inhibiting amount of at least one $C_3$ to $C_8$ acetylenic hydrocarbon or $C_3$ to $C_8$ acetnic halohydrocarbon compound.

15. The composition according to claim 14 wherein said acetylenic compound is present in an amount of from about 0.01 to about 1.0 weight percent, based on the total weight of solvent composition.

16. The composition according to claim 14 wherein said acetylenic compound is present in an amount of from about 0.1 to about 0.5 weight percent, based on the total weight of solvent composition.

17. The composition according to claim 14 wherein said cyclic ether is selected from the group consisting of 1,4-dioxane, 1,3-dioxolane, trioxane, δ-butyrolactone, and tetrahydrofuran.

* * * * *

UNITED STATES PATENT AND TRADEMARK OFFICE

CERTIFICATE OF CORRECTION

PATENT NO. : 5,990,071

DATED : November 23, 1999

INVENTOR(S) : RONALD L. SHUBKIN

It is certified that error appears in the above-identified patent and that said Letters Patent is hereby corrected as shown below:

Column 6, Line 10, reads "... δ-butyrolactone, ..." and should read -- ... γ-butyrolactone, ... --.

Column 6, Line 41, reads "... δ-butyrolactone, ..." and should read -- ... γ-butyrolactone, ... --.

Column 6, Line 60, reads "... $C_8$ acetnic halohy-" and should read -- ... $C_8$ acetylenic halohy- --.

Column 6, Line 60, reads "... δ-butyrolactone, ..." and should read -- ... γ-butyrolactone, ... --.

Signed and Sealed this

Thirtieth Day of January, 2001

*Attest:*

Q. TODD DICKINSON

*Attesting Officer*

*Director of Patents and Trademarks*